United States Patent [19]

Strait, Jr.

[11] Patent Number: 4,719,320

[45] Date of Patent: Jan. 12, 1988

[54] COAXIAL CABLE WITH COIL SUPPORTED BRAID STRUCTURE

[75] Inventor: Ross W. Strait, Jr., Madison, Conn.

[73] Assignee: Times Fiber Communications, Inc., Wallingford, Conn.

[21] Appl. No.: 856,377

[22] Filed: Apr. 28, 1986

[51] Int. Cl.[4] ..... H01B 7/22

[52] U.S. Cl. ..... 174/106 R; 174/107; 174/108; 174/109

[58] Field of Search ..... 174/106 R, 107, 108, 174/109, , 110 F, 110 FC

[56] References Cited

U.S. PATENT DOCUMENTS

| | | | |
|---|---|---|---|
| 1,951,723 | 3/1934 | Burd et al. | 174/108 |
| 2,141,290 | 12/1938 | Carlson et al. | 174/106 R |
| 3,130,256 | 4/1964 | Mildner | 174/107 |
| 3,408,453 | 10/1968 | Shelton, Jr. | 174/110 FC |
| 3,643,007 | 2/1972 | Roberts et al. | 174/106 R |
| 3,649,744 | 3/1972 | Coleman | 174/108 X |
| 4,317,000 | 2/1982 | Ferer | 174/108 X |
| 4,360,704 | 11/1982 | Madry | 174/107 X |
| 4,408,089 | 10/1983 | Nixon | 174/108 X |
| 4,443,657 | 4/1984 | Hill et al. | 174/110 FC |
| 4,472,597 | 9/1984 | Vematsu | 174/107 |
| 4,529,564 | 7/1985 | Harlow | 174/110 FC X |
| 4,552,432 | 11/1985 | Anderson et al. | 174/108 X |

FOREIGN PATENT DOCUMENTS

| | | | |
|---|---|---|---|
| 2444951 | 4/1976 | Fed. Rep. of Germany | 174/109 |
| 921453 | 3/1963 | United Kingdom | 174/110 FC |
| 1207117 | 9/1970 | United Kingdom | 174/108 |

*Primary Examiner*—Morris H. Nimmo

*Attorney, Agent, or Firm*—Bacon & Thomas

[57] ABSTRACT

A coaxial cable assembly including a coil supported braid structure is disclosed. The cable exhibits excellent mechanical strength while preserving the desirable features of flexibility and ease of installation.

2 Claims, 2 Drawing Figures

COAXIAL CABLE WITH COIL SUPPORTED BRAID STRUCTURE

BACKGROUND OF THE INVENTION

1. Technical Field of the Invention

The present invention is directed to a coaxial cable assembly including a coil supported braid structure which provides excellent mechanical strength while preserving the desirable features of flexibility and ease of forming at installation.

2. Description of the Prior Art

Conventional high performance coaxial cable and cable assemblies use the dielectric core of the cable as the primary radial support for braid structures that give these products their tensile and torsional strength. Thus, in cables which do not employ rigid dielectric cores, specifically low attenuation flexible cables, there is little radial support for braid structures incorporated therein. Such cables are highly susceptible to mechanical failure due to their low radial crush stength. Accordingly, there is a need in the art for a high performance, low attenuation coaxial cable which combines good flexibility with good mechanical strength and crush resistant properties.

SUMMARY OF THE INVENTION

The present invention provides a high performance, flexible coaxial cable having excellent mechanical strength properties. The cable of the invention comprises a center conductor, a flexible dielectric surrounding the center conductor, a flexible outer conductor surrounding the dielectric, a metal coil in the shape of a semi-close wound tension spring surrounding the outer conductor and at least one load bearing braid surrounding the metal coil. The cable may contain other elements as described in detail hereinafter.

DETAILED DESCRIPTION OF THE PREFERRED EMBODIMENTS

Figure 1:
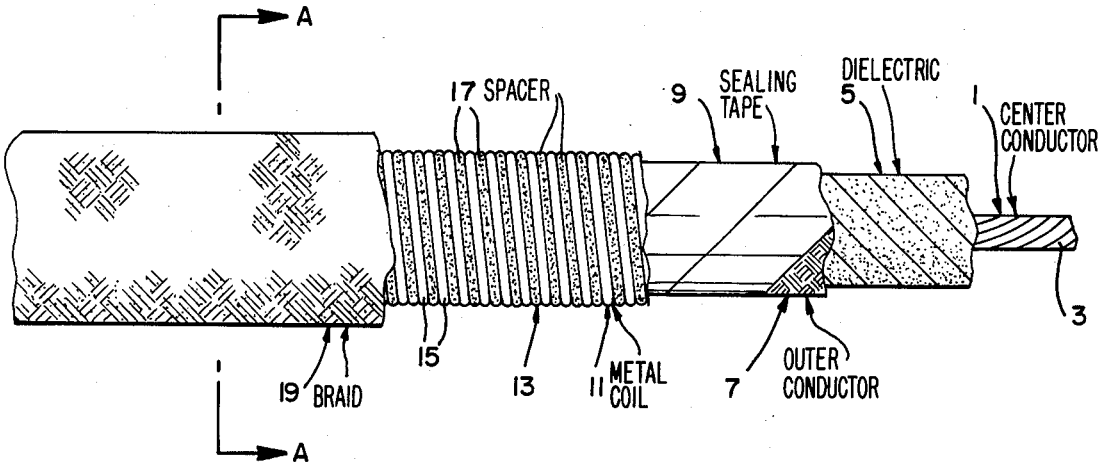
FIG. 1 shows a side view of a coaxial cable employing the coil supported braid structure in accordance with the invention.
Figure 2:
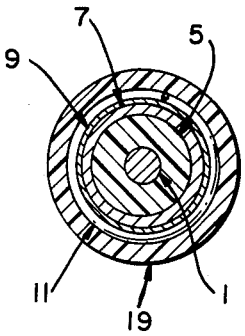
FIG. 2 shows a cross sectional view taken along line A—A of the coaxial cable of FIG. 1.

Referring to FIGS. 1 and 2, a coil supported braid cable in accordance with the invention is shown. The cable contains center conductor 1 which may be made from a variety of materials, although a stranded silver plated copper conductor is most preferred. The strands 3 which form the center conductor are wound together at a very gradual angle.

Adjacent to and concentric with the center conductor is dielectric 5. Because the cable is designed to be flexible, rigid dielectrics such as rigid polymer foams must be avoided. Instead, insulating tapes, particularly tapes made from polytetrafluoroethylene (Teflon) which are wound around the center conductor are preferred. For high performance broadband cables, it is most preferred to employ air articulated (expanded) Teflon tapes. Such tapes are a combination of solid material and air.

Adjacent to and concentric with dielectric 5 of the cable is outer conductor 7. This outer conductor can take many forms so long as it remains generally flexible. Hence, one or more metal braids or wound metallized tape can be employed. It is further preferred to seal the outer conductor by winding one or more sealing tapes 9 therearound to keep moisture, moisture vapor and harmful chemicals from penetrating into and degrading the performance of the coaxial cable. A preferred sealing material is a metallized polyimide foil which is covered with multiple layers of pressure sensitive polyimide tapes. When this material is wound over the outer conductor, it provides an effective barrier to both vapor and liquid ingress.

Metal coil 11, preferably made of stainless steel wire, formed into the shape of a semi-close wound tension spring whose inner diameter provides a close fit over the outer conductor 7 and any sealing element 9 provided thereover, imparting good radial strength without sacrificing flexibility. To maintain the flexibility of the cable assembly, the coil must remain semi-closed, i.e., with space between adjacent coil turns, rather than fully closed. Hence, a spacer coil 13 is preferably positioned within the metal coil such that each adjacent metal coil element 15 is separated by a spacer coil element 17. The spacer coil is made of a resilient non-metallic material such as nylon, polyethylene, polypropylene, etc. By varying the diameter of the spacer coil element 17, the distance between adjacent metal coil elements 15 can be varied. This, in turn, varies the minimum bend radius of the cable. Cables in which the distance between adjacent metal coil elements is relatively short will have higher minimum bend radii than cables with larger spaces between adjacent metal coil elements.

Tensile and torsional strength for the cable is provided by one or more outer strength braids 19. The braids are preferably made from woven synthetic resin fibers, particularly polyamide fibers, such as Kevlar (an aromatic polyamide or aramid fiber) and Nomex (a modified polyamide) available from DuPont de Nemours & Co., Inc. These synthetic resins are most preferred since they have high tensile strength, low thermal coefficients of expansion and excellent retention of physical properties over a wide range of temperatures. For example, Kevelar has an elastic modulus of $18\times10^6$ psi and a breaking point of 400,000 psi at room temperature which drops only to 150,000 psi at 400° F.

In a preferred embodiment, the cable contains two braids, an inner tensile and torsional load bearing braid of Kevlar and an outer abrasion resistant bread of Nomex which may be impregnated with a polyimide varnish. The latter should have a relatively high braid angle to assure that even if the cable is abraded in service, and the outer braid damaged, the overall braid structure will stay in place and not unravel. A braid angle greater than 45° is generally required for this purpose and a braid angle of approximately 60° has been found to be most preferred. A braid angle of approximately 45° is preferred for the inner load bearing braid since at this angle the braid, rather than the cable, carries most of the load from applied tensile and torsional forces.

While the present invention has been described in terms of certain preferred embodiments, one skilled in the art will readily appreciate that various modifications, changes, omissions and substitutions may be made without departing from the spirit thereof. It is intended, therefore, that the present invention be limited solely by the scope of the following claims.

I claim:

1. A coaxial cable comprising:

(i) a center conductor, (ii) a flexible dielectric surrounding the center conductor, (iii) a flexible outer conductor surrounding the dielectric, (iv) A metal coil in the shape of a semi-close wound tension spring surrounding the outer conductor, (v) at least one load bearing braid surrounding the coil, and (vi) means for maintaining said metal coil in a semi-close configuration.

2. The cable as claimed in claim 1, wherein said means comprises a spacer coil disposed within said metal coil and separating adjacent elements of the metal coil from each other.

* * * * *